US006038832A

United States Patent [19]

Focke et al.

[11] Patent Number: 6,038,832

[45] Date of Patent: Mar. 21, 2000

[54] APPARATUS FOR PRODUCING (LARGE) PACKS

[75] Inventors: Heinz Focke, Verden; Thomas Häfker, Langwedel; Martin Stiller; Michael Schlenker, both of Verden, all of Germany

[73] Assignee: Focke & Co (GmbH & Co.), Verden, Germany

[21] Appl. No.: 09/064,871

[22] Filed: Apr. 23, 1998

[30] Foreign Application Priority Data

Apr. 23, 1997 [DE] Germany ..... 197 16 930

[51] Int. Cl.[7] ..... B65B 11/58

[52] U.S. Cl. ..... 53/234; 53/53; 53/502; 53/252; 53/253

[58] Field of Search ..... 53/234, 251, 252, 53/253, 233, 232, 231, 225, 224, 53, 502

[56] References Cited

U.S. PATENT DOCUMENTS

| | | | |
|---|---|---|---|
| 4,428,177 | 1/1984 | Focke et al. | 53/234 X |
| 4,646,508 | 3/1987 | Focke | 53/234 |
| 4,711,065 | 12/1987 | Focke et al. | 53/234 X |
| 4,718,216 | 1/1988 | Focke et al. | 53/234 X |
| 5,249,416 | 10/1993 | Adams et al. | 53/234 X |

FOREIGN PATENT DOCUMENTS

| | | |
|---|---|---|
| 529404 | 3/1993 | European Pat. Off. . |
| 262765 | 2/1911 | Germany . |
| 1238378 | 4/1967 | Germany . |
| 2355310 | 8/1974 | Germany . |
| 3433428 | 3/1986 | Germany . |
| 4335666 | 4/1995 | Germany . |

*Primary Examiner*—James F. Coan
*Attorney, Agent, or Firm*—Sughrue, Mion, Zinn Macpeak & Seas, PLLC

[57] ABSTRACT

In the production of large packs (10) each comprising a pack group (11), in particular comprising cigarette packs (12), different-wrapper versions have to be taken into account. For this purpose, two folding turrets (21, 22) for different packaging material are provided, namely a folding turret (21) for cardboard blanks (13) and a folding turret (22) for blanks (20) made of paper or film. The two folding turrets (21, 22) are arranged one beside the other in horizontal alignment. Each folding turret (21, 22) is provided with four pockets which each run through three operating stations.

18 Claims, 10 Drawing Sheets

32
27
26
98
31
33
94
97
93
94
34
36
96
28
98
93
35
37
29
39
21
93
30
97
23
38
96
23
93
50
29
95
51
24
57
56
55
10
106
42
42
45
103
56
49
54
49
103
44
46
46
45
22
24
106
44
103
60
49
48
10

APPARATUS FOR PRODUCING (LARGE) PACKS

BACKGROUND OF THE INVENTION

The invention relates to an apparatus for producing packs by wrapping articles in alternatively one or more blanks, in particular for producing large packs comprising pack groups having a first folding turret for wrapping articles in a blank, in particular a cardboard blank, and having a second folding turret for wrapping articles in another blank, in particular a paper or film blank, such that the folding turrets, which are arranged adjacent to one another and revolve in a common upright plane, each have four pockets which are open in the radial direction for receiving articles and blanks and such that the articles can be pushed into a respective pocket located in a horizontal center plane of the first folding turret or of the second folding turret.

The main concern of the invention is the packaging of groups of cigarette packs, that is to say the production of so-called cigarette cartons. These usually comprise ten or twelve cigarette packs which have been combined to form a cuboidal or cubic unit. The cigarette cartons are usually formed in two rows of five cigarette packs in each case.

Depending on market requirements, the design of the cigarette cartons may differ with respect to the packaging material. The wrapper often comprises a (thin) cardboard blank. This may additionally be enclosed on the outside by a film (with a tear-open strip) or by paper. Instead of this, it is also possible for the pack group to be wrapped in only a paper blank or a film blank.

SUMMARY OF THE INVENTION

The object of the invention is to propose an apparatus and further means which makes it possible to produce all types of packs using a single apparatus, along with high output and reliable functioning of the latter.

In order to achieve this object, the apparatus according to the invention is characterized by the following features:

a) the article or pack group always pass through both folding turrets, b) after being inserted into a pocket, the article or pack group can be conveyed along a semicircular path lying above the horizontal center plane, c) the packs can be pushed out of the second folding turret in the horizontal plane and into an adjoining horizontal pack conveyor, d) the cardboard blanks can be fed from a blank magazine arranged below the folding turret to a push-in station of the first folding turret via a blank web.

An apparatus with the aforementioned features makes it possible to produce multipacks, especially those for cigarettes, in a very efficient manner. All articles or pack groups run along the same conveying path, regardless of the type or number of wrappers. Folding and gluing elements are arranged in the region of the upper half of the folding turret which is positioned in the upright plane. The manner in which the packaging material is fed represents another advantage, in that the blanks of thin cardboard are fed from a position below the folding turret. This arrangement keeps the cut or punched blanks free of any dust or paper particles that may fall down from above.

Another special feature of the apparatus is the configuration and function of elements in the region of a pack station assigned to the first folding turret. In this region groups of (cigarette) packs are formed and held ready for insertion into a pocket of the first folding turret.

Another special feature of the invention is the application of glue to the folding or connecting tabs of the blanks. A gluing unit for folding tabs of the cardboard blank is positioned in the region of the first folding turret in such a way that glue can be applied to the outer side of an interior folding tab. A special feature for gluing paper blanks is that an outer folding tab can be moved out of its folded position or deformed (rolled up) so that its inner side faces outwards and can be glued.

Of further significance is the design of the folding turret and its pockets, which are formed by push rods or push rod heads.

According to the invention, the completely folded packs are checked by scales, with any pack exceeding the weight tolerance limit being ejected.

Other features and special characteristics of the invention are outlined below in more detail according to the accompanying drawings in which:

DESCRIPTION OF THE PREFERRED EMBODIMENTS

Figure 1:
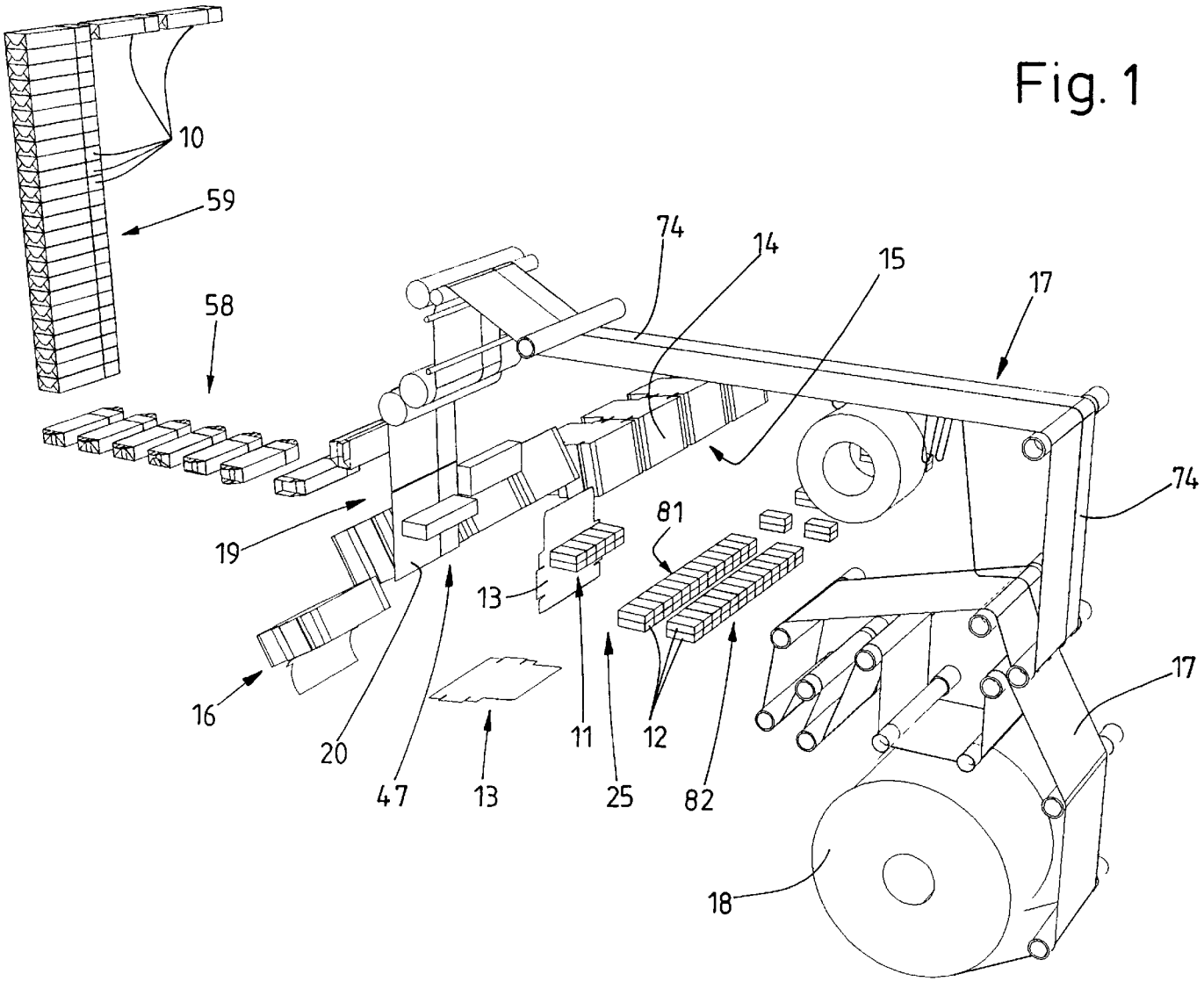
FIG. 1 shows a perspective illustration of the material flow through the apparatus.

The preferred application example which is illustrated in the drawings relates to the production of large packs 10 comprising a group of individual packs, that is to say a pack group 11. The latter, in turn, preferably comprises cigarette packs 12. In the case of the present example, a pack group 11 is formed by ten cigarette packs 12. The cigarette packs 12 are positioned in two rows located one above the other.

The large packs 10—so-called cigarette sticks—comprise a pack group 11 which is wrapped by one or more blanks made of packaging material.

The apparatus and the details thereof are geared towards producing large packs 10 with different outer wrappers. An outer wrapper may comprise a cardboard blank 13. The latter encloses the pack group 11 completely, that is to say on all sides. The cardboard blanks 13, which have specific contours, are produced separately, for example in a paper mill. The present packaging machine is fed stacks 14 of blanks. In the present case, a stack row 15 comprising successive stacks 14 of blanks is fed, transversely with respect to the conveying direction of the pack groups 11, right into the region of a blank magazine 16. A supply of cardboard blanks 13 located one above the other is always held ready in said magazine. Individual blanks are removed one after the other from the underside of said magazine. In accordance with the position of the cardboard blanks 13 or of the stacks 14 of blanks in the blank magazine, the stacks 14 of blanks are moved, during transportation in the stack row 15, into an obliquely directed tilting position (FIG. 1) and are transferred to the blank magazine 16 in this position.

The thin-walled packaging material, namely paper or film, is provided as a continuous material web 17. The material web 17 is drawn off from a reel 18, which is positioned in the region of the apparatus, and fed to a severing or cutting station 19 via deflecting rollers 35 and units which will be described in detail. In the region of said severing or cutting station, in a vertical plane, (thin-walled) blanks 20 made of paper or film are severed one after the other from the material web 17 and held ready for the purpose of wrapping a pack group 11.

The apparatus is based on two folding turrets, namely a first folding turret 21 and a second folding turret 22. These are positioned one beside the other, with the result that the axes of rotation are located in a common horizontal plane. The first folding turret 21 serves for wrapping a pack group 11 using a cardboard blank 13. In the region of the second folding turret 22, which adjoins in the conveying direction, a pack group 11 is enclosed by a blank 20 made of paper or film. This blank 20 may enclose a pack group 11 directly as the only wrapper. Alternatively, however, it is possible for the blank 20 to be folded around a cardboard blank 13 which has already been provided as a wrapper, with the result that the large pack 10 has two outer wrappers.

The pack group 11 is always conveyed through both folding turrets 21, 22, to be precise along two upwardly directed semicircular movement paths, which are connected by a short rectilinear movement in the horizontal center plane. Depending on the type of outer wrapper for the pack group 11, it is possible for both folding turrets 21, 22, or just one folding turret 21 or 22, to be activated for packaging purposes. If the wrapper comprises just a cardboard blank 13, the large pack 10 runs, with said cardboard blank 13, through the second folding turret 22 without the latter applying a further blank. If, in contrast, the large pack 10 is provided just with a (thin) blank 20 made of paper or film, the pack group 11 runs through the first folding turret 21 without having a wrapper applied to it. Only the second folding turret 22 is activated for packaging purposes.

Each folding turret 21, 22 comprises four pockets 23, 24. In the case of the first folding turret 21, the pockets 23 are arranged centrally with respect to radial planes of the folding turret 21, each at a distance apart from one another of 90'. In the case of the folding turret 22, the pockets 24 are offset with respect to the radial planes. An imaginary axis of rotation of the folding turret 22 is offset with respect to an axis of rotation of the folding turret 21, namely it is located at a higher level. Adjacent pockets 23 and 24 of the two folding turrets 21 and 22 are located at the same level.

Each folding turret 21, 22 has three operating positions, and the pockets 23, 24 run through these positions during stepped rotation of the folding turrets 21, 22.

Figure 6:
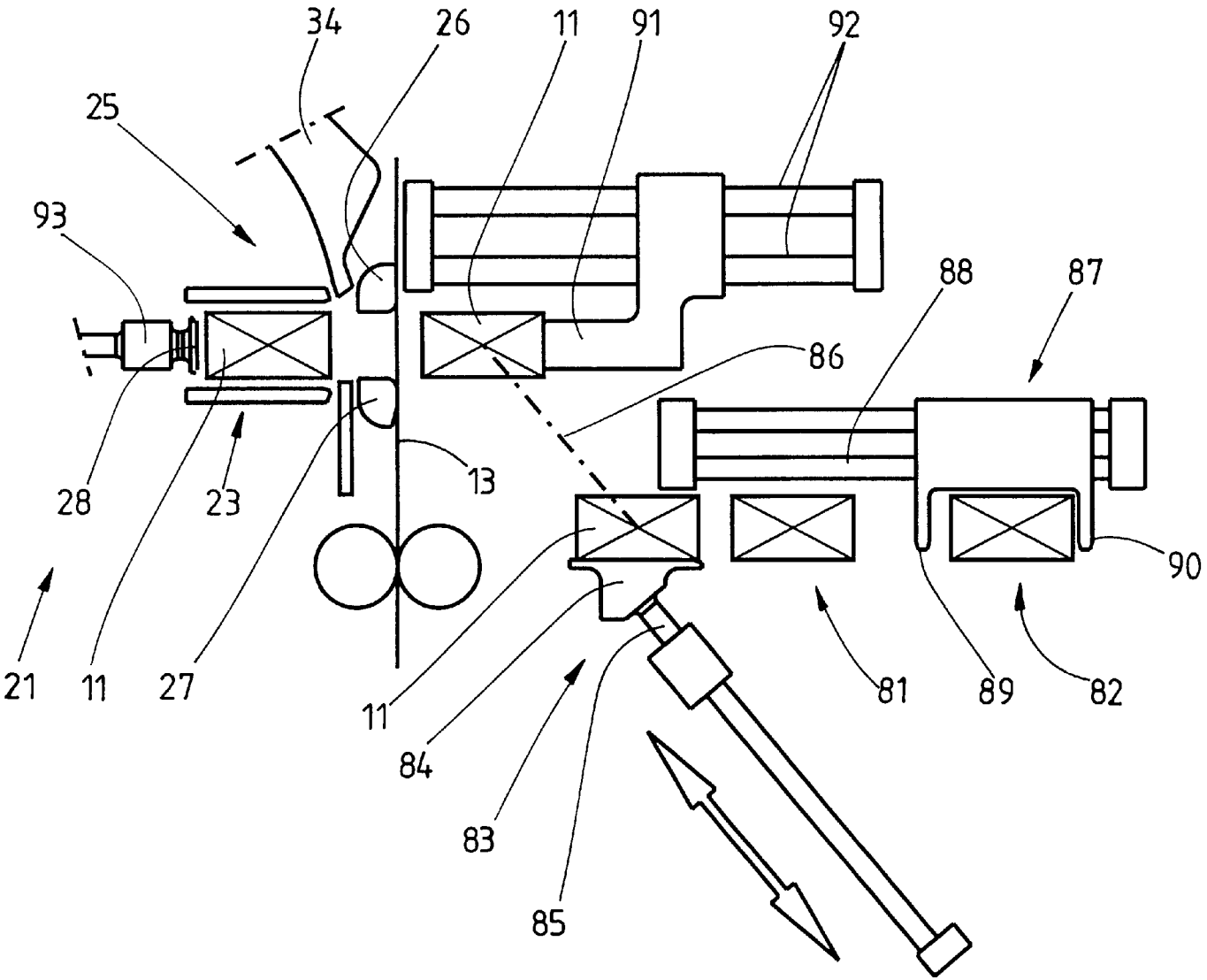
FIG. 6 shows a detail in the region of a first folding turret, namely a pack station, in side view.

In the case of the folding turret 21, a push-in station 25 is located in the region of a horizontal center plane of the apparatus. An article or a pack group 11 is pushed into the pocket 23, which is open on the outside, and carries along a cardboard blank 13 in the process. Arranged upstream of the respective pocket 23, in a stationary manner, is a mouthpiece with top and bottom folding profiles 26, 27. The pack group 11 is pushed through between these folding profiles 26, 27, in the process carrying along the cardboard blank 13 which is held ready in a vertical plane (FIG. 6). The action of the folding profiles 26, 27 causes said blank to be positioned around the pack group 11 in the form of a U. In this folding position, the pack group 11 is pushed, along with a cardboard blank 13, into the pocket 23.

Figure 2:
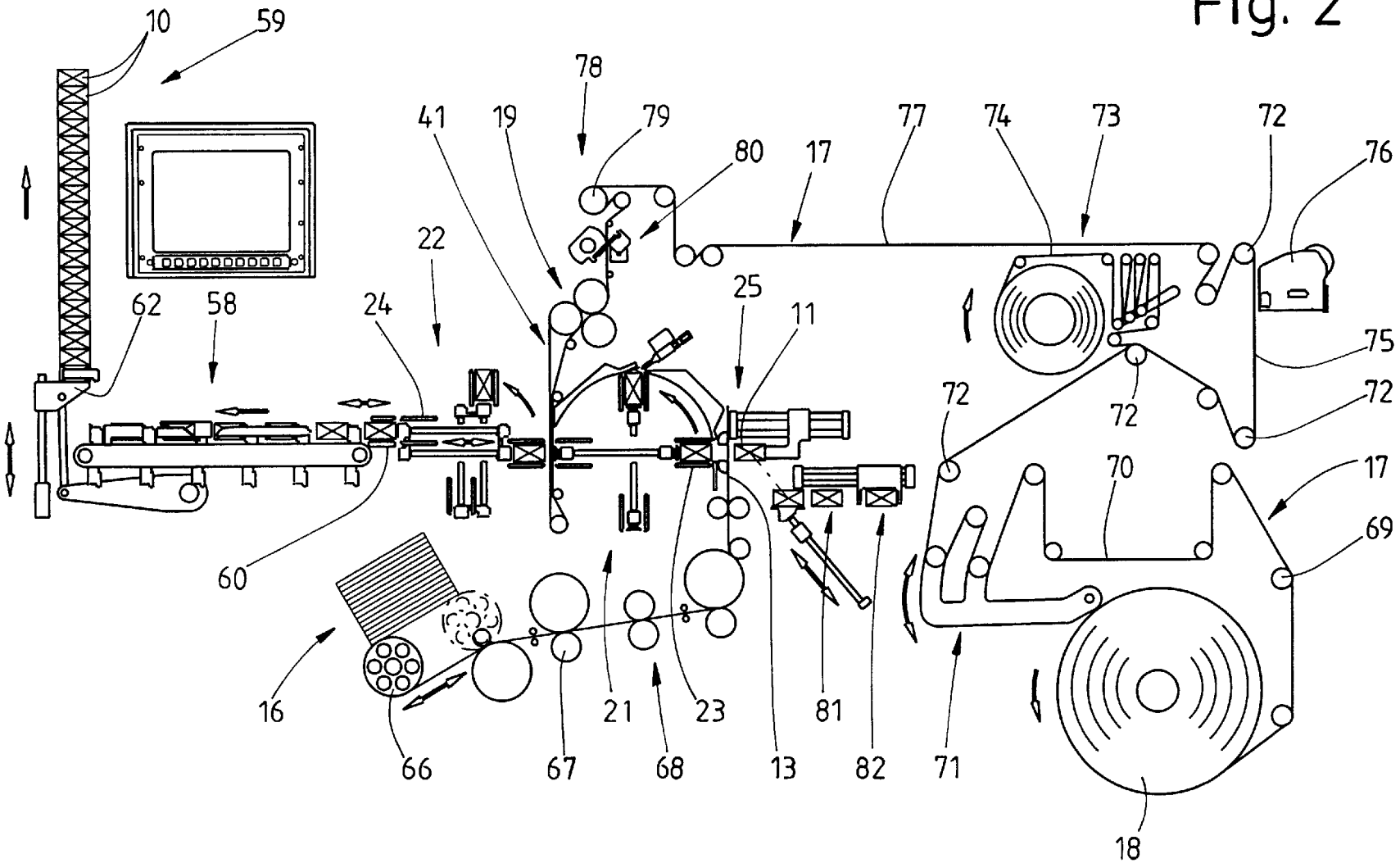
FIG. 2 shows a simplified illustration of the apparatus in side view.

Each pocket 23 is assigned a slide 28, 29. At the same time, the latter form the radially inner boundary of the pocket 23, that is to say an inner pocket base. The two slides 28, 29 of diametrically opposite pockets are connected to one another in terms of movement, to be precise by one (or two) common push rods 30. A pushing-out movement of one slide (29 in FIG. 3) causes the other slide 28 to draw back radially. The slide 28 is located, in the region of the push-in station 25, first of all in a radially outer position, directed towards the open inlet side of the pocket 23 and/or the (large) pack 10 which is to be pushed in. When a pack group 11 is pushed into the pocket 23, the slide 28 is moved back inwards first of all into an intermediate position according to FIG. 4, in which the slide 28 is positioned at a distance from the pocket 23 in the radial direction. This positioning results from a pushout position of the opposite slide 29. Thereafter, the slide 28 returns into a position in which it is directed towards the pocket 23 (FIG. 2). Once this position has been reached, the folding turret 21 is shifted on by a stepped interval of 90'.

The cardboard blank 13 is positioned relative to the pack group 11 such that, when pushed into the pocket 23 in the U-shaped folding position, folding tabs of different lengths are formed as projections, namely an inner tab 31 and an outer tab 32, on the radially outer side. In the region of the push-in station 25, the inner tab 31 is folded against a radially outer side of the pack group 11 (FIG. 4), to be precise by a folding plate 33 which can move up and down or tangentially. The folding plate 33 remains in the folding position according to FIG. 4 as the stepped rotation of the folding turret 21 begins.

The second folding tab, namely the outer tab 32, is folded during the rotational movement of the folding turret 21, to be precise by a fixed, circle-arc-shaped outer guide 34. The latter is positioned directly adjacent to the movement path of the folding turret 21 and causes the outer tab 32 to be folded as a result of the relative movement of the pocket 23 together with the cardboard blank 13.

The pocket 23 with pack group 11 and partially folded cardboard blank 13 passes into a top, gluing station 35. In the latter, the pocket 23 is positioned in an upright plane. The folding tabs 31, 32 are located at the top.

Said folding tabs, namely the inner tab 31 and outer tab 32, are to be connected to one another by adhesive bonding. For this purpose, in the gluing station 35, glue is applied, to be precise onto the outwardly directed side of the inner tab 31, by a gluing unit 36. In the case of the present example, the gluing unit 36 comprises a glue nozzle 37 which, during axis-parallel movement, applies glue to the elongate inner tab 31 in the longitudinal direction.

A special feature is realized for the glue application. The tabs which are folded in the manner described, namely the inner tab 31 and outer tab 32, are released in the region of the gluing station 35. Material stressing and resulting restoring forces cause the inner tab 31 and outer tab 32 to move automatically into oblique positions, namely at an acute angle with respect to the closing plane of the large pack 10.

Figure 7:
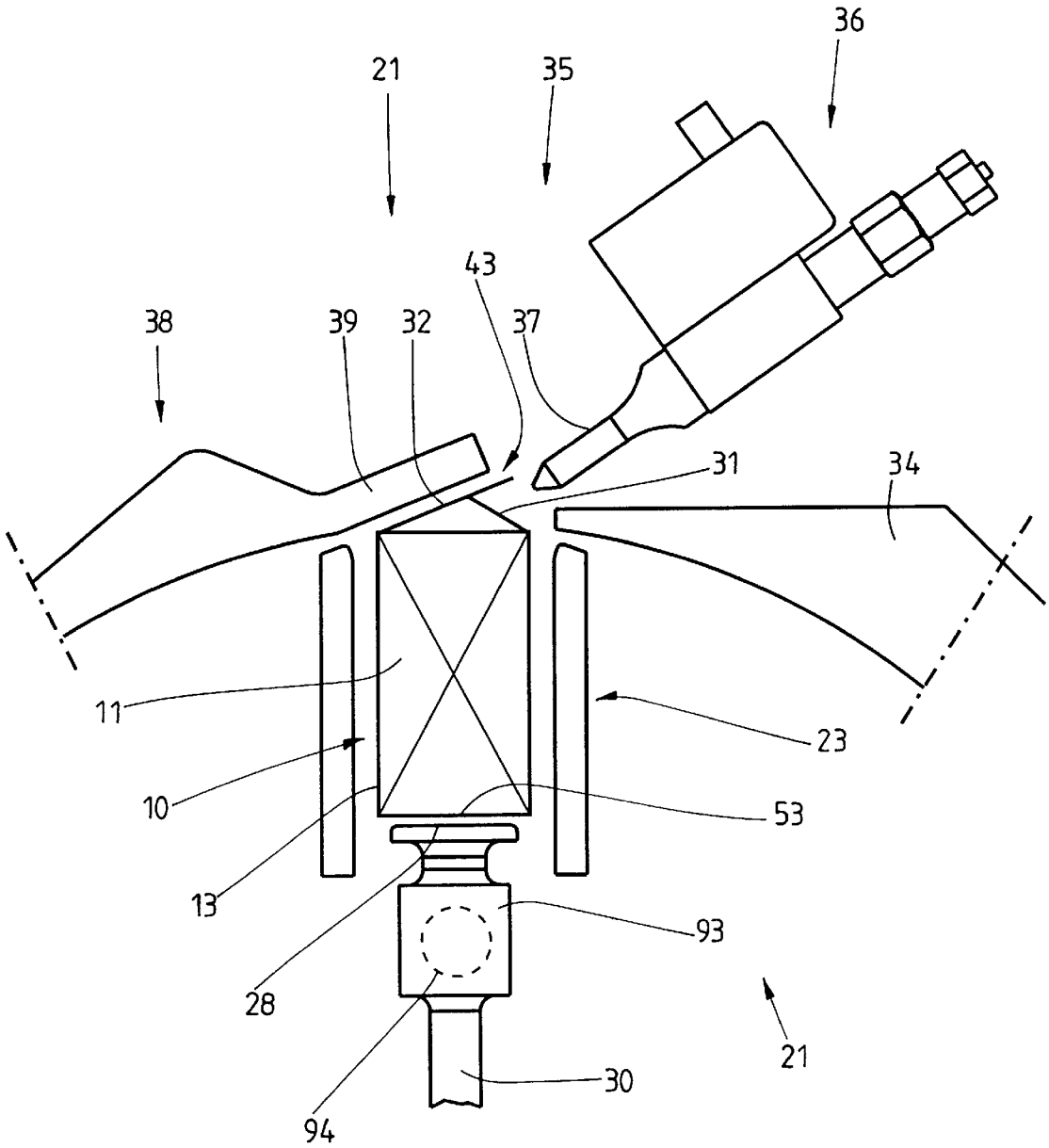
FIG. 7 shows a further detail of the first folding turret, namely a folding and gluing station, likewise on an enlarged scale.

In this case, the (narrower) inner tab 31 is supported on the inside of the outer tab 32 (FIG. 7). As a result, part of the outside of the inner tab 31 is exposed. Taking this positioning of the folding tabs 31, 32 into account, the glue nozzle 37 is directed obliquely, with the result that the glue can be applied to the free side of the inner tab 31.

In order to ensure this positioning of the folding tab 31, 32, the outer guide 34 is interrupted in the region of the gluing station 35. A second outer guide 38, which adjoins in the circumferential direction, is provided, in the region of the gluing station 35, with an obliquely directed guide leg 39, the relative position of which corresponds approximately to the relative position of the outer tab 32 in the region of the gluing station 35, or runs parallel thereto.

Once the glue has been applied in the gluing station, the folding turret 21 is shifted on by one stepped interval. In this case, the relevant pocket 23 passes, along with the large pack 10, into the region of the outer guide 38, or into the region of a circular guide contour of the same. As a result, the folding tabs, namely the inner tab 31 and outer tab 32, are forced into the folding position and connected to one another by the glue which has been applied.

The pocket 23 then passes into a push-out station 40, which is diametrically opposite the push-in station 25. In the push-out station 40, the large pack 10 is pushed out of the pocket 23 in the radial direction by the slide 29 and, at the same time, pushed to the second folding turret 22 or to a pocket 24 which is held ready opposite the pocket 23. The slide 29 conveys the pack 10 right into the pocket 24 in the process.

If the large pack 10 is to be provided with an outer wrapper made of paper or film, a blank 20 made of paper or film is held ready in the region of transfer from the folding turret 21 to the folding turret 22. The blank 20 is located in an upright tangential plane with respect to the two folding turrets 21, 22. Once it has been severed from the material web 17, the blank 20 is conveyed by an upright blank conveyor 41, which in the present example comprises suction belts which grip the blank 20 laterally, into the receiving position, which can be seen from FIG. 3.

A special feature is that, in the receiving position, the blank 20 is fixed in terms of the position relative to the (large) pack 10. For this purpose, the blank 20 is retained by clamping in the correct pack-specific relative position between the pack 10 which is to be pushed out of the folding turret 21 and a retaining element, namely a push rod 42 of the receiving folding turret 22. In this case, the blank 20 butts, on the one hand, against a side surface 43, which is located at the front in the conveying direction of the large pack 10, and, on the other hand, against a free surface of the push rod 42.

Figure 4:
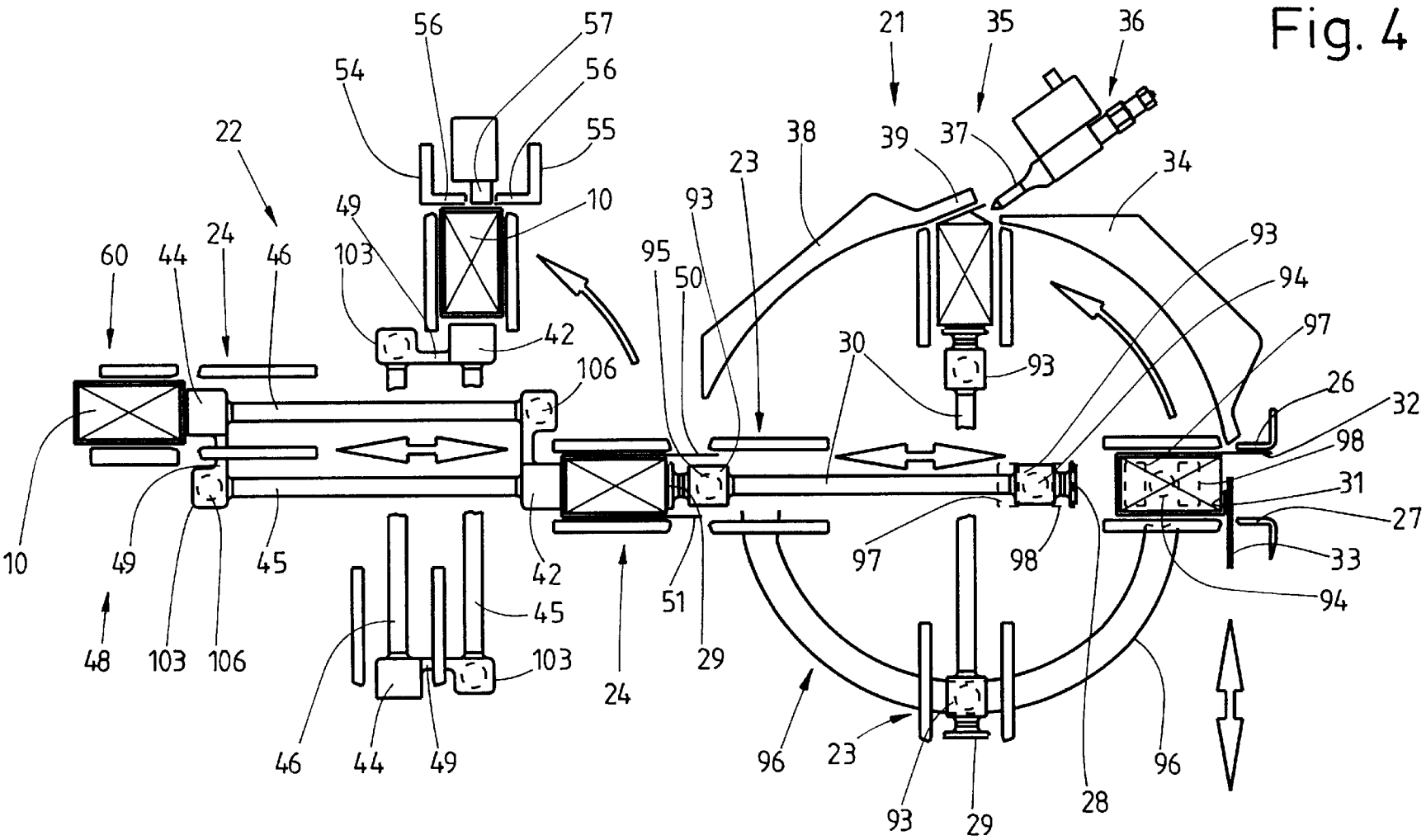
FIG. 4 shows the view according to FIG. 3 with elements in different positions.

Upon continued pushing-out movement by the slide 29 and a corresponding retracting movement of the push rod 42, the blank 20 is pushed, together with the large pack 10, into the pocket 24, the clamping position for said blank 20 being maintained in the process. In this case, the blank 20 is folded around the large pack 10 in the form of a U in a known manner (FIG. 4).

The second folding turret 22 is constructed analogously to the folding turret 21, namely with four pockets 24 arranged at equal angular distances from one another. Each pocket is assigned a push rod 42, 44. The push rods 42 and 44 of diametrically opposite pockets 24 are connected to one another in terms of movement, namely via push-rod stems 45, 46. The folding turret 22 is designed such that the mutually opposite pockets 24 are located in offset planes. The pocket 24 which is located, in the region of a push-out station 48, opposite the receiving pocket 24 in the region of a transfer station 47 is offset vertically and, in the case of the present example, is located in a higher plane. Analogously to this, the other two pockets 24 in each case, namely those in the top and bottom positions of the folding turret 22, are located in offset vertical planes.

For this reason, two parallel push-rod stems 45, 46, which are connected to one another at the ends by crossmembers 49, are provided for the purpose of actuating the push rods 42 and 44. Movement of the push rod 42 in one direction causes the push rod 44 to move in an opposite direction.

Once the pack 10 has been pushed, with the blank 20, into a pocket 24 of the folding turret 22, outwardly projecting folding tabs 50 and 51 are formed in the radial direction. The pack 10 is conveyed, with these radially projecting folding tabs 50, 51, into a (top) closing station of the folding turret 22 by way of the pocket 24. In said closing station, first of all the folding tabs 50 and 51 are moved into the closing position by folding elements, namely with abutment against a side surface 53 of the pack 10. Serving for this purpose are transversely moveable, namely pivotable, folders 54, 55 which, in the case of this example, are designed as angular profiles with folding legs 56.

In the folding position (FIG. 4), the folders 54, 55, or the folding legs 56 thereof, are positioned at a distance from one another, with the result that, in an approximately central region a closing tool 57 can pass through until it butts against the side surface 53 of the pack 10. This tool is, in particular, a sealing tool, that is to say a sealing jaw, which, if a film is used as the outer wrapper, connects the folding tabs 50, 51 to one another by virtue of heat-sealing. In the case of a blank 20 made of paper, the latter may be provided with glue which can be heat-activated (hot melt). This glue too results in the folding tabs 50, 51 being connected to one another by the application of heat and pressure.

Further rotation of the folding turret 22 causes the pack 10 to pass into the push-out station 48. Appropriate movement of the push rod 44 pushes the pack 10 out of the pocket 24 and transfers it to a pack conveyor 58. The latter transports the packs 10 via a horizontal conveying section. At the end of the pack conveyor 58, the packs 10 are introduced into a pack tower 59, in which the packs 10 are stacked individually one above the other. At the top, the packs 10 are conveyed away from the pack tower 59 in the horizontal direction.

Figure 5:
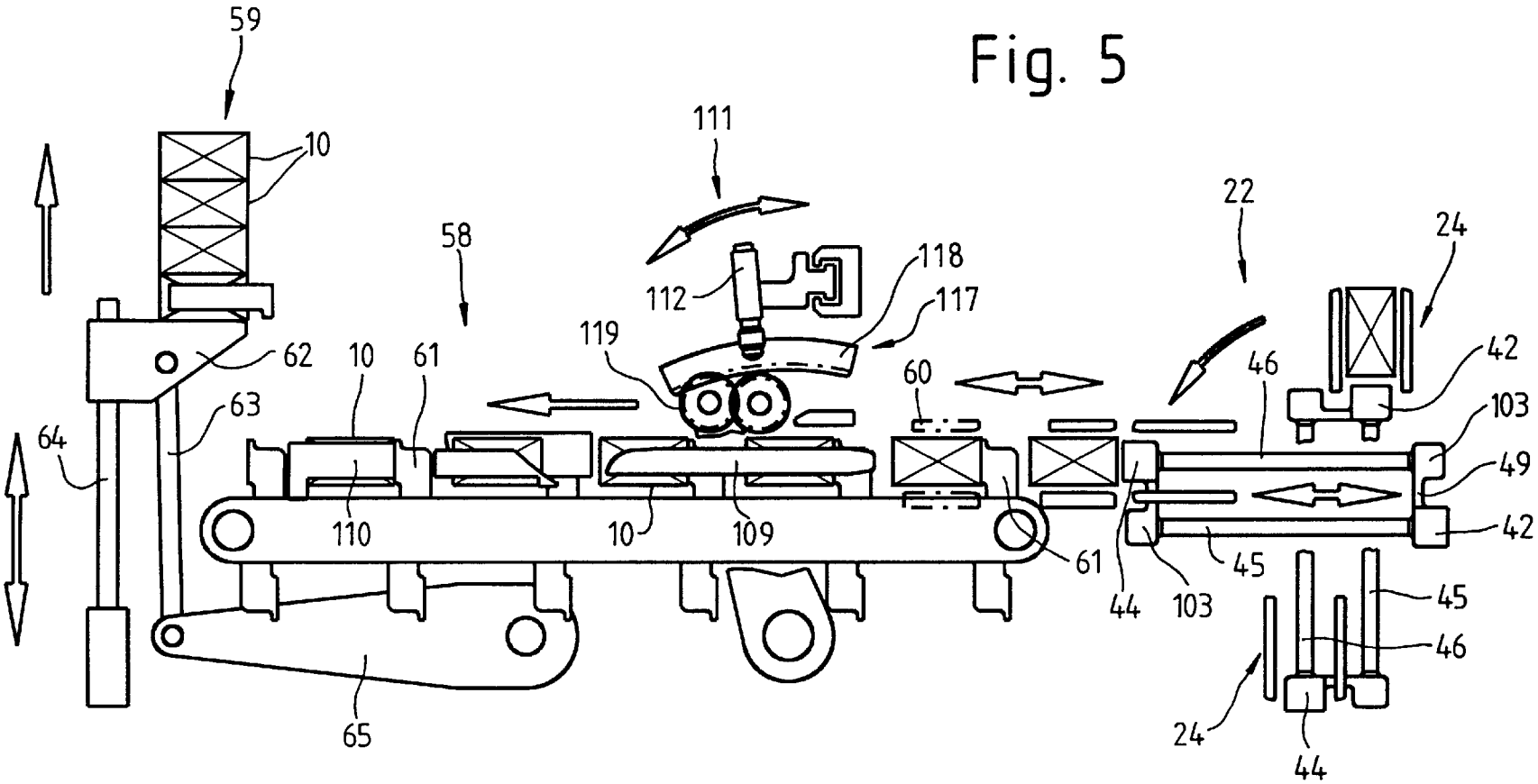
FIG. 5 shows another region of the apparatus, likewise in side view and on an enlarged scale.

The packs 10 are not transferred directly to the pack conveyor 58 from the folding turret 22. Rather, a special feature is that the packs 10 which have been pushed out of the pocket 24 are transferred to an intermediate platform 60. The movement of the push rod 44 is controlled such that the pack 10 is displaced until it is deposited fully on the intermediate platform 60. The intermediate platform 60 can move back and forth, namely from a position in which it receives the packs (for example FIG. 3) into a position in which it transfers the packs 10 to the pack conveyor 58 (FIG. 5, chain-dotted lines). The intermediate platform 60 comprises at least a top guide and a bottom guide for the packs 10. The intermediate platform 60 can move back and forth for receiving the packs 10 and transporting them further. At least the bottom guide, that is to say a bottom wall of the intermediate platform 60, is provided with a slit for the through-passage of carry-along elements 61 of the pack conveyor 58.

The pack conveyor 58 is designed as an endless conveyor. The packs 10, located on a base, are conveyed by carry-along elements 61. The latter are arranged on an endless element, in particular on a chain. The carry-along elements 61 are arranged at regular intervals from one another. These intervals are dimensioned such that the largest possible type of pack 10 is received between adjacent carry-along elements 61. Accordingly, the pack conveyor 58 can be used, without any changes, for any relevant type of pack.

Folds in the outer wrapper, that is to say the blank 20, to be precise in the region of laterally directed end surfaces, are completed. in the region of the pack conveyor 58. For this purposes, folded rails or folding diverters 109, which fold laterally overlapping tabs of the blank 20 in a manner known per se, are arranged on both sides of the pack conveyor 58. Moreover, a sealing element 110 is positioned in an end region of the pack conveyor 58 and subjects the folding tabs of film blanks 20 to heat-sealing. In the case of blanks 20 made of paper, hot-melt regions can be activated.

The pack conveyor 58 deposits the packs 10 on a lifting platform 62 at the end of the conveying section. Said lifting platform can be moved up and down by a lifting rod 63. The pack 10 which has been received by the pack conveyor 58 is introduced into the pack tower 59 at the bottom by virtue of upward movement by the lifting platform 62. The lifting platform 62 can be displaced on fixed, upright guide rods 64 by a pivot arm 65.

The conveying movement of the pack conveyor 58 is always constant—irrespective of the size, that is to say dimensioning in the conveying direction, of the large pack 10. This results in predetermined, constant relative positioning of the packs 10 in the pack tower 59. The right-hand boundary (FIG. 2, FIG. 5) of the pack tower remains unchanged, irrespective of the transverse dimensioning of the packs 10.

Figure 3:
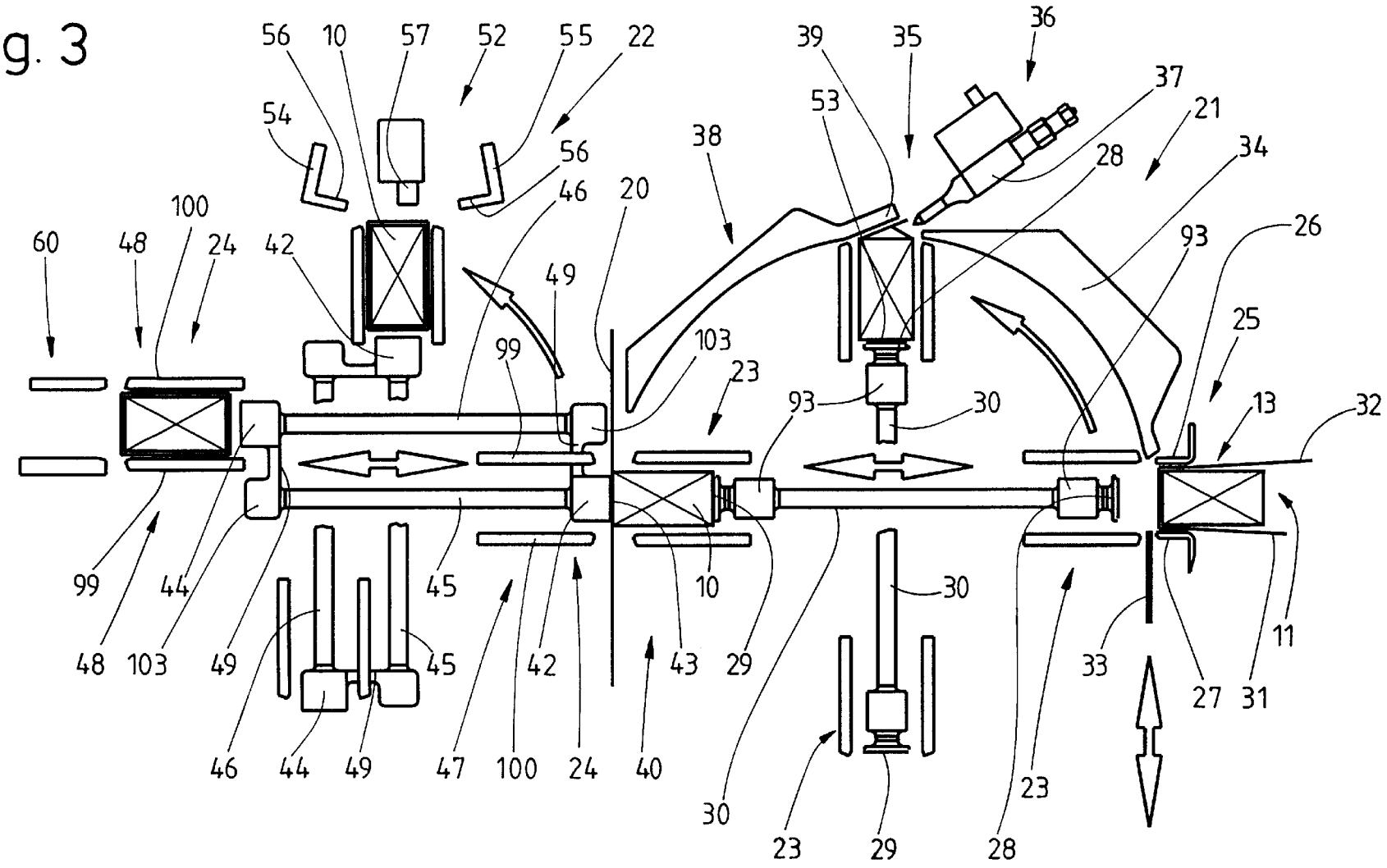
FIG. 3 shows, on an enlarged scale, a sub-region of the apparatus in side view.

The material-supply means to the apparatus is of specific design in functional and spatial terms. The blank magazine 16 for the cardboard blanks 13 is located beneath the folding turrets 21, 22, specifically approximately in the region beneath the folding turret 22. The cardboard blanks 13 which have been removed by a take-off roller 66 are transported, by transporting rollers 67, along a blank path 68 beneath the folding turrets 21, 22 and deflected into a vertical conveying plane. In the region of the push-in station 25, the cardboard blanks 13 are conveyed into the push-in position fro m beneath one after the other and are held ready in this position in order to be carried along by a pack group 11 (FIG. 3).

Handling of the web-like packaging material is also achieved in a specific manner. The reel 18 is positioned in a bottom region of the machine, namely beneath the plane of the folding turrets 21, 22. The material web which has been drawn off from the reel 18 is first of all guided via a plurality of deflecting rollers 69. Edge-control means (not shown specifically) or the material web 17 are set up in the region of a horizontal web section 70. In this region, the precise direction in which the material web 17 runs is controlled via known elements.

A concentrating pendulum 71, the construction and functioning of which are known, follows. This pendulum controls the stressing in the web.

The material web is then fed to a strip unit 73 via further deflecting rollers 72. Said strip unit transfers a tear-open strip 74 to the material web 17 to be precise at the relative position which corresponds to the large pack 10 which will be provided. The material web 17 provided with the (continuous) tear-open strip 74 is then guided past a printing unit 76 in the region of an upright web section 75. In the case of blanks 20 made of paper in particular, but also in the case of film blanks, said printing unit can provide desired printing on the material web. It is also possible for said printing to be constituted by printing marks for controlling the material web 17 over an adjoining , horizontal conveying section 77, the material web 17 passes, above the plane of the folding turrets 21, 22, into the region of a blank station 78. Here, the material web 17 is conveyed downwards by deflecting rollers 79. In the case of the present example, a cutting unit 80 is arranged in the region of a first, upright conveying section. If necessary, said cutting unit may provide preliminary cuts in the region of the material web 17, in particular severing cuts for defining an outer cover tab in the region of end surfaces of the large pack 10. Such cover or label tabs are conventional, in particular, in outer wrappers comprising a blank 20 made of paper.

The material web 17 then passes into the region of the cutting station 19, which severs the blanks 20 from the material web 17. During the severing operation, the material web 17, or the blank 20, is already located in the region of the upright guide and conveying elements, namely of the blank conveyors 41. These hold the blank 20 ready in the aforementioned vertical plane in the transverse station 47.

A further special feature is the operation of feeding individual packs, namely cigarette packs 12, to the push-in station 25. As can be seen, in particular, from FIG. 6, cigarette packs 12 are fed to the push-in station 25 in an axis-parallel direction, in two pack rows 81, 82, to be precise in a conveying plane which is located beneath the plane in which the pack group 11 is pushed into the folding turret 21. In the present case, each pack row 81, 82 comprises two rows, located one above the other, of the cigarette packs 12 (FIG. 1). Accordingly, from each continuous pack row 81, 82 comprising two individual rows, a pack group 11 of the desired size and formation can be separated off directly by virtue of being pushed off transversely.

A pack lifter 83 is provided for this purpose. Said pack lifter is provided with a platform 84, on which a number of cigarette packs 12 which corresponds to the pack group 11 is received. In the present case, the platform 84, which is provided on a push rod 85, can be moved up and down in an oblique movement direction 86. From a bottom position, in which it is remote from the push-in position, the platform 84 can be moved upwards, and simultaneously sideways, in the movement direction 86 into a push-in position directly in front of a pocket 23 of the folding turret 21. For this purpose, the push rod 85 is mounted in a correspondingly oblique position. The individual packs or the pack group 11 are or is separated off from the pack row 81 or 82 by virtue of transverse displacement and, at the same time, are or is pushed onto the platform 84. Provided for this purpose is a transverse slide 87, which grips the pack group 11 laterally and displaces it until it rests on the platform 84. The transverse slide 87 is mounted movably on (horizontal) guide rods 88.

The transverse slide 87 is designed in a specific manner, namely as a double slide with two carry-along elements 89 and 90 arranged at a distance from one another. A pushing movement of the transverse slide 87 causes, in a first step conveying interval (corresponding to FIG. 6), a pack group 11 of the remote pack row (on the right in FIG. 6) to be displaced transversely by one stepped movement interval, namely into an intermediate position corresponding to the position of the pack row 81. This pack group 11 is conveyed by the carry-along is element 90. At the same time, the carry-along element 89, which is arranged at a corresponding distance away, pushes a pack group 11 off from the pack row 81 until it rests on the platform 84. Said pack group 11 on the platform 84 is fed to the push-in station 25 in the manner described.

The conveying movement of the individual packs or cigarette packs 12 which follow in the region of each pack row 81, 82 is stopped by stop elements (not shown) which can be moved into the movement path of the cigarette packs 12 of the pack rows 81, 82. These stop elements release the pack rows 81, 82 for conveying purposes again in accordance with the pushing-off operation of the pack groups 11. Following the aforementioned stepped conveying interval of the transverse slide 87 in the direction of the platform 84, the transverse slide 87 is moved out, for example by lifting, of the region of the displaced pack group. The transverse slide 87 returns into the initial position according to FIG. 6. During the next stepped conveying interval, namely once the platform 84 has returned into the bottom, initial position, the conveying movement of the transverse slide 87 is repeated, the carry-along element 89 gripping the pack group 11 which has previously been set down in the region of the pack row 81 and pushing it onto the platform 84. The transverse slide 87 then returns again into the initial position (FIG. 6). The stop elements for the pack rows 81, 82 are drawn back. The two pack rows 81, 82 are then conveyed on into the operating region of the transverse slide 87. A special feature is that the transverse slide 87 always executes a uniform movement back and forth for the purpose of conveying away pack groups 11 of the two pack rows 81, 82.

The pack group 11 which is held ready in the top end position of the platform 84 is pushed off from the platform 84, and into the pocket 23, by a push-in element 91. The push-in element 91 is mounted on supporting rods 92 such that it can move back and forth.

A further special feature is formed by the controlled movement of the slides 28, 29, on the one hand, and of the push rods 42, 44 on the other hand. During rotational movement of the folding turret 21, the slides 28, 29 are positioned such that the slide 28 which is directed towards a filled pocket 23 butts against the facing side of the (large) pack 10, that is to say it forms a pocket base (FIG. 4, at the top). For this purpose, laterally projecting guide rollers 94, 95 are provided on the slides 28, 29 or on the thickened actions 93 directed towards the slides 28, 29. In each case one guide roller 94 and 95 enters, during rotational movement of the folding turret 21, into a stationary curved path, namely into a guide groove 96. In the case of the present example (FIG. 4), said guide groove is arranged in the region of the bottom half of the folding turret 21, preferably as part of an approximately semicircular, stationary plate. When the push rod 30 has returned into the normal position when the pack 10 has been pushed out of a pocket 23 in the region of the transfer station 47, the guide roller 95, which is directed towards the slide 29, is located in the (top) inlet region of the guide groove 96 (position according to FIG. 2). Upon rotation of the folding turret 21, the guide roller 95 enters into the guide groove 96 from above. This ensures the aforementioned position of the opposite slide 28 against the pack 10 in the pocket 23. The guide groove 96 extends as far as the underside of the pocket 23 in the region of the push-in station 25.

In the region of this push-in station 25 and opposite, in the region of the transfer station 47, the two guide rollers 94, 95 are outside the guide groove 96. This permits displacement of the push rod 30 in one direction or the other.

In order to execute the displacement, namely the movement for pushing the packs 10 out of the pocket 23 in the region of the transfer station 47, a separate actuating element acts on the slides 28, 29. In the present case, this element comprises two slide segments 97, 98 which act approximately in the horizontal center plane of the folding turret 21. The web-like slide segments 97, 98 are spaced apart from one another by a distance which, in the case of the appropriate relative position (on the right of FIG. 4) permits the guide roller 94 to enter into the region between the slide segments 97, 98. If these are then moved in one direction or the other (by an element which is not shown), the unit comprising the slides 28 and 29 and the push rod 30 is thus displaced at the same time, to be precise into the end position which can be seen in FIG. 4. Following the pushing-out operation in the region of the transfer station 47, the said unit is moved back by the slide segments 97, 98 such that the guide roller 95 is located on the inlet side of the guide groove 96.

Figure 8:
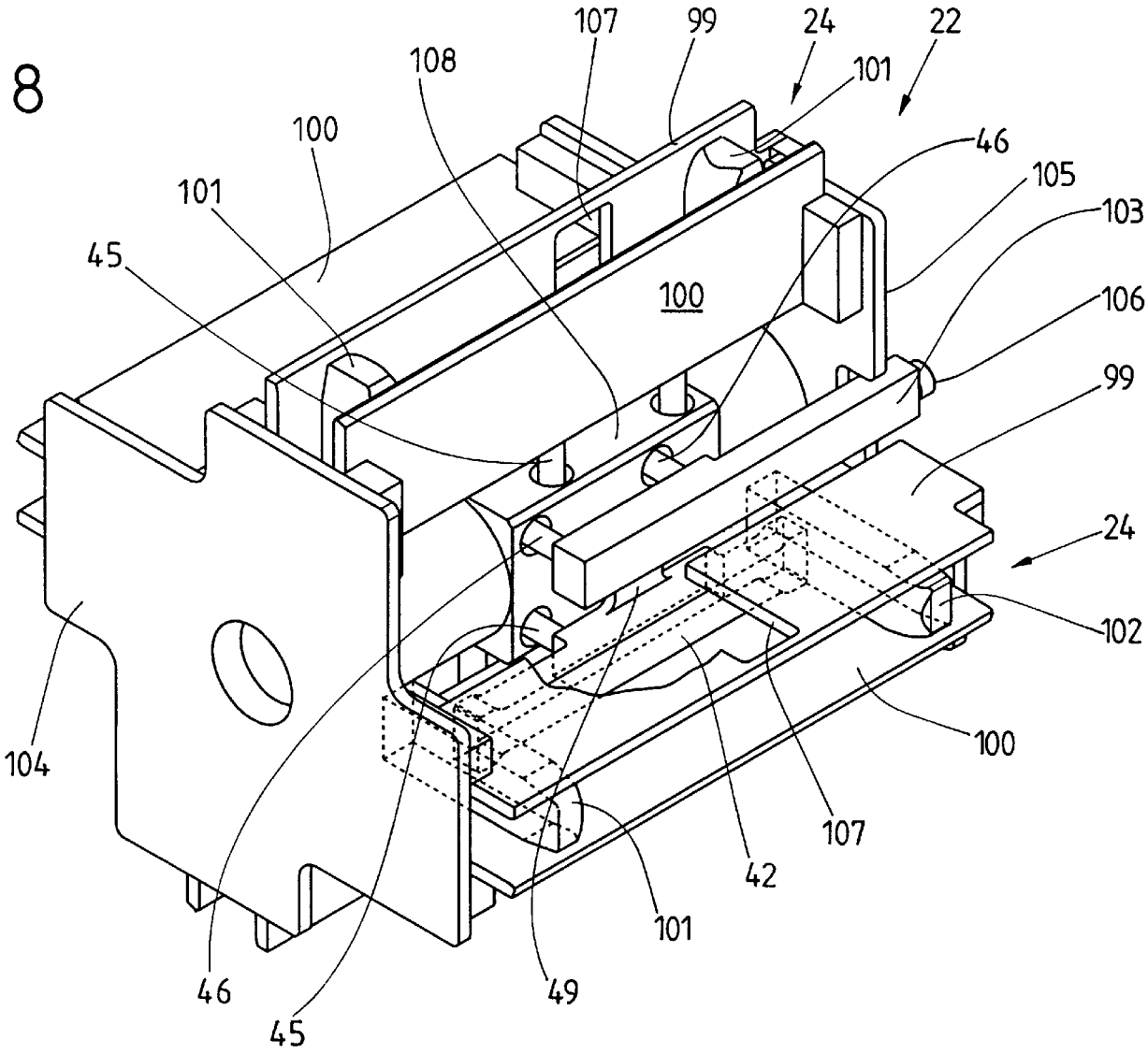
FIG. 8 shows a perspective illustration of a second folding turret.

The folding turret 22 is of analogous design. Furthermore, this is shown in FIG. 8.

The pockets 24 of said folding turret 22 comprise two parallel pocket plates 99, 100. The pack group 11 or the (large) pack 10 is received between these plates. The pocket 24 is bounded laterally by side pieces 101, 102. These form side walls of the pockets 24. The side pieces 101, 102 are arranged in a transversely adjustable manner between the pocket-plates 99, 100. By virtue of at least one side piece 101, 102 being adjusted, it is possible for the effective width of a pocket 24 to be adapted to the format of the pack group 11. As a result of their positioning and form, the side pieces 101, 102 also have the function of folding elements. When a pack group 11 or large pack 10 wrapped by a blank 20 in the form of a U is pushed in, laterally projecting tabs of the blank 20, which are at the front in the conveying direction, are folded by the side pieces 101, 102.

The side pieces 101, 102 mean that it is not possible for elements for actuating the push rods 42, 44 to enter into the pocket 24 from the side. For this purpose, actuating bars 103, which are directed transversely or arranged parallel to the elongate push rods 42, 44, are arranged outside the pockets 24, namely above or beside the pocket plates 99 in each case (FIG. 8) The actuating bars 103 each run, parallel to the push rods 42, 44, into a lateral region beside supporting walls 104, 105 of the folding turret 22. In each case one contact roller 106 is arranged at the ends of the actuating bars 103 which project from this region. Said roller enters into a curved groove analogous to the guide groove 96 of the folding turret 21 and causes the aforementioned displacement of the push rods 42, 44 during rotational movement of the folding turret 22 and/or while the latter is at a standstill. For this purpose, the actuating bars 103 are connected to the respectively associated push rod 42, 44 by the transversely directed crossmembers 49. The crossmembers pass through slit-like cutouts 107 which are formed in the region of a pocket plate 99.

The actuating bars 103 are guided by in each case two parallel push-rod stems 45 or 46, the push-rod stems 45 or 46 which are connected to an actuating bar 103 on one side being connected to an opposite push rod 42 or 44 at the other end. The push rods 42, 44 are mounted in a central, cuboidal supporting body 108 of the folding turret 22 or of a central body of rotation of the same.

Figure 9:
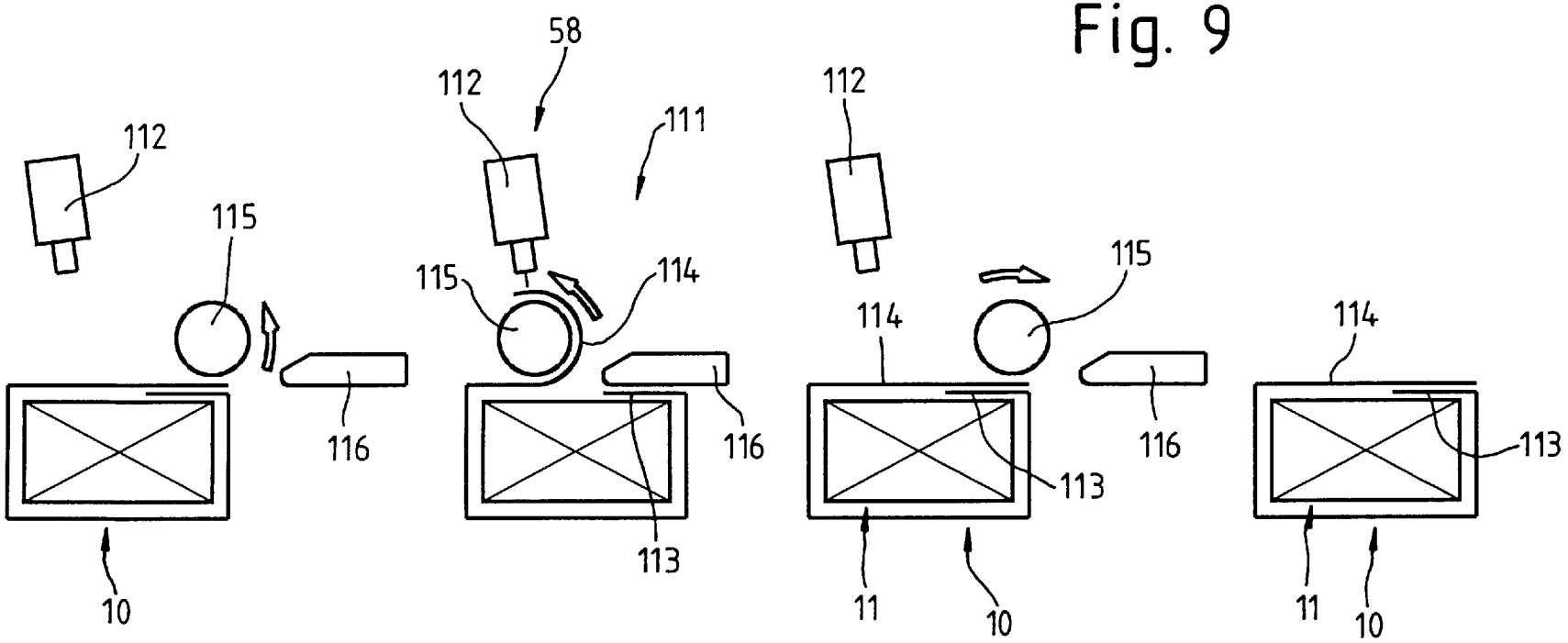
FIG. 9 shows the steps of applying glue to a folding tab, especially of a paper blank, in a schematic side view.

A further, independently applicable special feature is the application of glue to areas of the blank 20 of paper or the like. In the region of the pack conveyor 58 a glue station 111 is formed with a glue unit 112 equipped with glue nozzles for applying glue from above onto the blank 20. The latter is mostly folded in the region of the glue station 111, encompassing at any rate the article to be wrapped (FIG. 9, right). The article—pack group 11—is wrapped by the blank 20 such that an overlap is formed on the upper side, comprising a relatively short inner tab 113 and an outer tab or cover tab 114. The latter extends in the present case across the entire width of the pack 10 and is bonded by glue with the inner tab 113.

Since packs are transported in the region of the pack conveyor 58, each pack enters the region of a holding element for the (not yet glued) cover tabs 114. In the present exemplary embodiment this involves a suction roll 115, that is to say an elongated element that revolves about its own axis. Suction bores, which are connected to a vacuum source, open out on the outer side of the latter and generate negative pressure along the circumference of the suction roll 115. In the region of this element—suction roll 115—the cover tab 114 is gripped by the suction roll 115 and held in place along the circumference of the latter. Due to the revolving movement of the suction roll 115 and the axial-transverse displacement in the conveying direction, the cover tab 114 is rolled up on the suction roll 115 in such a way that a region of the cover tab 114 opposite the inner tab 113 faces upwards in an end position of the suction roll 115. In the process, the cover tab 114 is held so that its inner side is directed upwards or outwards, specifically, immediately adjacent to the gluing unit 112 or the latter's gluing nozzle. The glue can now be applied to the inner side of the cover tab 114 from above. Due to the continued movement of the packs, the cover tab 114, now applied with glue, is drawn from the suction roll 11 and returned to its correct packaging position, with the suction roll 115 applying the necessary pressure.

To make sure that the inner tab 113 is not raised along with the cover tab 114 in the gluing station, a holding element is provided, namely a pressure web 116. After the cover tab 114 has been raised, said pressure web 116 lies upon the inner tab 113 and holds it in its folding position.

A controlling unit 117 is provided for the operation of the suction roll 115. This unit comprises a toothed quadrant 118 and a cogwheel 119 that combs with the toothed quadrant. The cogwheel 119 is in turn connected to the suction roll 115 so that movement in the conveying direction causes the suction roll 115 to revolve at the same time, here in the a counter-clockwise direction. After glue has been applied to the cover tab 114 (FIG. 9, left position), the suction roll returns to its initial position by means of counter rotation.

Figure 10:
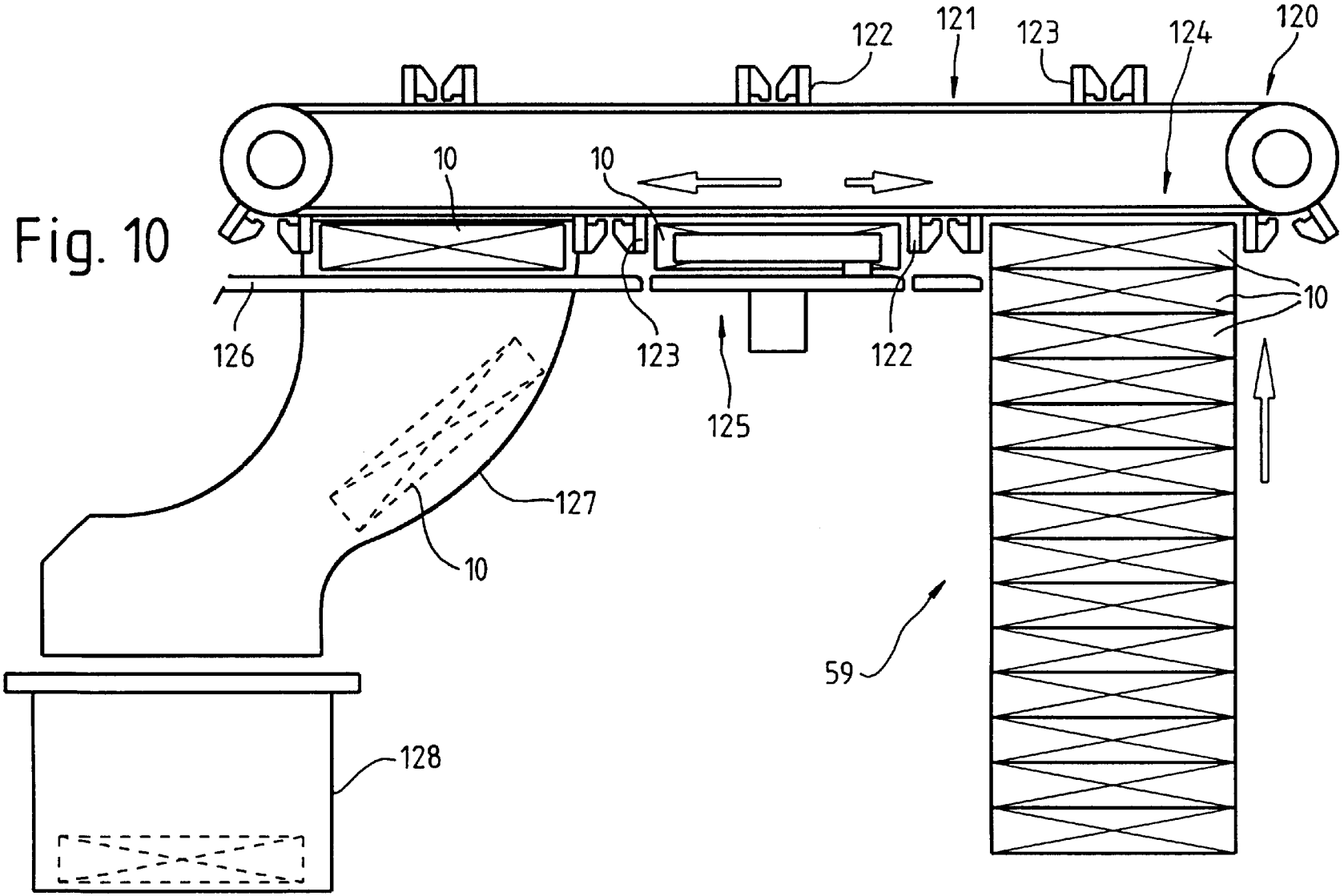
FIG. 10 shows a region of the apparatus after the packs have been completed but before they have been removed for transport, in side view.

FIG. 10 shows a special feature relating to the handling of completed (large) packs 10. The packs 10 moved upwards in the pack tower 59 reach a region of an upper transverse conveyor 120. The latter comprises an endless conveyor or a belt 121. Arranged on its outer side are carry-along elements 122, 123 assigned to each pack 10. A lower strand 124 of the belt 121 grips the respective top pack 10 in the pack tower 59 and carries the pack 10 away in a transverse direction. The pack 10 is sent along the transverse conveyor 120 to pack scales 125, which is arranged in the movement path of the packs 10. The weight of the pack 10 is measured on the pack scales 125. If its weight lies beyond the tolerance limit, the pack 10 is sorted out. To this end the weighed packs 10 are conveyed by means of the transverse conveyor 120 from the pack scales 125 to a conveyor plate 126. Connected laterally to this plate is a shaft 127 open at the top. Faulty packs 10 are pushed off the conveyor plate 126 in the transverse direction into the shaft 127 located next to the conveyor plate 126. The shaft leads the packs into a collecting box 128.

What is claimed is:

1. An apparatus for producing packs (10) by wrapping articles in alternatively one or more blanks for producing large packs (10) comprising pack groups (11), said apparatus comprising a first folding turret (21) for wrapping articles in a cardboard first blank (13), and a second folding turret (22) for wrapping articles in a second blank (20) of paper or film, wherein each of the folding turrets (21, 22), which are arranged adjacent to one another and and rotate about respective axes in circular paths in a common upright plane, has four pockets (23, 24) open in the radial direction for receiving articles and blanks, and wherein the articles are pushed into respective pockets (23, 24) located in a horizontal center plane of the first folding turret (21) or of the second folding turret (22), said apparatus further comprising:

a) means for always passing each article or pack group (11) through both folding turrets (21, 22), b) wherein, after being inserted into a pocket (23, 24), the article or pack group (11) in both folding turrets (21, 22) is conveyed, with a respective blank (13, 20), by the respective folding turret exclusively along a semicircular path lying above the horizontal center plane;

c) means for pushing the packs (10) out of the second folding turret (22) in the horizontal plane and into an adjoining horizontal pack conveyor (58);

d) means for feeding the cardboard blanks (13) from a blank magazine (16), arranged below the folding turrets (21, 22), to a push-in station of the first folding turret (21) via a blank web (68); and e) cutting means (19), located above the first folding turret (21), for severing the second blanks (20) made of paper or film from a web (17) which is drawn off from a reel (18), and for transporting the severed blanks, in a plane above the first folding turret (21) into a position between the two folding turrets (21, 22) to be received by a respective article or pack group (11) being pushed out of the first folding turret (21) and into the second folding turret (22).

2. The apparatus according to claim 1, wherein:

a) every pocket (23, 24) of each folding turret (21, 22) is associated with a slide (28, 29) or push rod (42, 44) which operates in a radially interior region of the pockets (23, 24) and which temporarily serves as an inner boundary of the pockets (23, 24), b) the slides (28, 29) or push rods (42, 44) of diametrically opposite pockets (23, 24) are movable and connected to one another by a common push rod (30) or push-rod stem (45, 46) which is movable back and forth in the radial direction, c) the slides (28, 29) or push rods (42, 44) are adjustable during the rotational movement of each folding turret (21, 22) by means of a guide roller (94, 95) or contact roller (106) connected to the respective slide (28, 29) or push rod (42, 44), with the guide roller (94, 95) or contact roller (106) abutting a curved path (96), and d) the second blank (20), which is fed in the region between the first folding turret (21) and the second folding turret (22), is held in place in terms of the pack-specific position, by being clamped between a pack (10) or pack group (11), pushed out of the first folding turret (21), and a push rod (42) which has been moved into a receiving position and belongs to the second folding turret (22).

3. Apparatus according to claim 2, characterized in that the slides (28, 29) in the horizontal position, directed towards a push-in station (25) and a push-out station (40), can be moved in a radial direction by a separate actuating element comprising stationary slide segments (97, 98) which act in the region of at least one of the guide rollers (94, 95), by movement in the radial direction, in order to actuate the two slides (28, 29).

4. Apparatus according to claim 1, characterized in that the second folding turret (22) has pockets (24) which are offset with respect to the associated imaginary radial plane, and in that, correspondingly, the axis of rotation of the second folding turret (22) is offset vertically with respect to the axis of rotation of the first folding turret (21), and is located at a higher level, such that, in the region of a transfer station (47), a pocket (24) which belongs to the second folding turret (22) and is offset downwards with respect to a horizontal radial plane is located in the same horizontal plane as a pocket (23) of the first folding turret (21).

5. Apparatus according to claim 1, characterized in that push rods (42, 44) which are assigned to the pockets (24) of the second folding turret (22) are actuated by push-rod stems (45, 46) which are located outside the pockets (24) and are connected to the push rods (42, 44), which are arranged within the pockets (24), by crossmembers (49) which pass through cutouts (107) in walls of the pockets (24).

6. The apparatus according to claim 1, characterized in that, in a region of the second folding turret (22), a second blank (20), which has been folded in the form of a U and consists of paper or film, has radially outwardly directed folding tabs (50, 51) which are folded in a region of a closing station (52), by pivotable, angular folders (54, 55), the folders (54, 55), in the folding position, leaving exposed a central region through which a closing tool (57) passes for the purpose of sealing or adhesively bonding the partially overlapping folding tabs (50, 51).

7. The apparatus according to claim 1, characterized in that web-like packaging material for producing the second blanks (20) is drawn off, as a material web (17), from a reel (18) which is positioned beneath the folding turrets (21, 22) and offset with respect to the first folding turret (21), and in that the material web (17) is transported, via deflecting rollers and processing stations, into a region above the folding turrets (21, 22), the material web (17) being fed from above to a cutting station (19) for the purpose of severing the blanks (20), in a region approximately between the two folding turrets (21, 22).

8. The apparatus according to claim 1, further comprising:

means for checking finished packs (10) in a region of pack scales (125) to determine whether their weight corresponds to a specified standard weight, the top pack (10) of a pack tower (59) of packs (10), arranged above one another, being conveyed by a transverse conveyor (120) to the pack scales (125); and means for inserting packs determined to be faulty into a shaft (127) connected to the pack scales (125).

9. An apparatus for producing packs (10) by wrapping articles in alternatively one or more blanks for producing large packs (10), comprising pack groups (11), said apparatus comprising a first folding turret (21) for wrapping articles in a cardboard first blank (13), and a second folding turret (22) for wrapping articles in a second blank (20) of paper or film blank, wherein each of the folding turrets (21, 22), which are arranged adjacent to one another and rotate about respective axes in circular paths in a common upright plane, has four pockets (23, 24) open in the radial direction for receiving articles and blanks, and wherein the articles are pushed into respective pockets (23, 24) located in a horizontal center plane of the first folding turret (21) or of the second folding turret (22), said apparatus further comprising:

a) means for always passing each article or pack group (11) through both folding turrets (21, 22), b) means for conveying, after being inserted into a pocket (23, 24), the article or pack group (11) along a semicircular path lying above the horizontal center plane;

c) means for pushing the packs (10) out of the second folding turret (22) in the horizontal plane and into an adjoining horizontal pack conveyor (58); and d) means for feeding the cardboard blanks (13) from a blank magazine (16) arranged below the folding turrets (21, 22) to a push-in station of the first folding turret (21) via a blank web (68);

wherein the pockets (24) of the folding turret (22) comprise two parallel pocket walls or pocket plates (99, 100) between which side pieces (101, 102) are arranged as a lateral boundary or side wall of the pockets (24), the side pieces (101, 102) being adjustable relative to one another in order to change a spacing therebetween, and wherein the side pieces (101, 102) serve at the same time as folding elements for pushing in a pack group (11) with the second blank (20).

10. An apparatus for producing packs (10) by wrapping articles in alternatively one or more blanks for producing large packs (10), comprising pack groups (11), said apparatus comprising a first folding turret (21) for wrapping articles in a cardboard first blank (13), and a second folding turret (22) for wrapping articles in a second blank (20) of paper or film blank, wherein each of the folding turrets (21, 22), which are arranged adjacent to one another and rotate about respective axes in circular paths in a common upright plane, has four pockets (23, 24) open in the radial direction for receiving articles and blanks, and wherein the articles are pushed into respective pockets (23, 24) located in a horizontal center plane of the first folding turret (21) or of the second folding turret (22), said apparatus further comprising:

a) means for always passing each article or pack group (11) through both folding turrets (21, 22), b) means for conveying, after being inserted into a pocket (23, 24), the article or pack group (11) along a semicircular path lying above the horizontal center plane;

c) means for pushing the packs (10) out of the second folding turret (22) in the horizontal plane and into an adjoining horizontal pack conveyor (58);

d) means for feeding the cardboard blanks (13) from a blank magazine (16) arranged below the folding turrets (21, 22) to a push-in station of the first folding turret (21) via a blank web (68); and wherein, in a region of the first folding turret (21), a pack group (11), which has been wrapped in a cardboard blank (13) in the form of a U, is conveyed out of a push-in station (25), along a quarter-circle, into a gluing station (35), so that, before or during a stepped conveying interval, radially outwardly directed folding tabs, (31) and (32) of the cardboard blank (13) are folded, wherein, in a region of the gluing station (35), the folding tabs (31, 32) are set up and moved into an oblique position, and wherein, in this oblique position, glue is applied onto an outside of an exposed folding tab (31).

11. An apparatus for producing packs (10) by wrapping articles in alternatively one or more blanks for producing large packs (10), comprising pack groups (11), said apparatus comprising a first folding turret (21) for wrapping articles in a cardboard first blank (13), and a second folding turret (22) for wrapping articles in a second blank (20) of paper or film blank, wherein each of the folding turrets (21, 22), which are arranged adjacent to one another and rotate about respective axes in circular paths in a common upright plane, has four pockets (23, 24) open in the radial direction for receiving articles and blanks, and wherein the articles are pushed into respective pockets (23, 24) located in a horizontal center plane of the first folding turret (21) or of the second folding turret (22), said apparatus further comprising:

a) means for always passing each article or pack group (11) through both folding turrets (21, 22), b) means for conveying, after being inserted into a pocket (23, 24), the article or pack group (11) along a semicircular path lying above the horizontal center plane;

c) means for pushing the packs (10) out of the second folding turret (22) in the horizontal plane and into an adjoining horizontal pack conveyor (58);

d) means for feeding the cardboard blanks (13) from a blank magazine (16) arranged below the folding turrets (21, 22) to a push-in station of the first folding turret (21) via a blank web (68); and a pack lifter (83) having a platform (84), wherein pack groups (11) which are to be wrapped are separated from at least one pack row (81, 82), which is fed in the axis-parallel direction, by virtue of a pack group (11) being pushed onto the platform (84) of the pack lifter (83), wherein, in a bottom initial position beneath a pocket (23) of the first folding turret (21) which is to be charged, the platform (84) receives a pack group (11) and, by virtue of obliquely directed upward movement, transports the pack group (11) into a position in front of the pocket (23).

12. Apparatus according to claim 8, characterized in that two parallel pack rows (81, 82) are fed in the axis-parallel direction to a push-in station (25) of the folding turret (21), and in that pack groups (11) from the two pack rows (81, 82) in each case are separated off by a transverse slide with two carry-along elements (89, 90) each assigned to one pack row (81, 82), the transverse slide (87) always executing the same conveying movements, such that the pack groups (11) of the pack rows (81, 82) transported in each case by a predetermined stepped movement interval and in each case one pack group (11) is deposited on the platform (84).

13. An apparatus for producing packs (10) by wrapping articles in alternatively one or more blanks for producing large packs (10), comprising pack groups (11), said apparatus comprising a first folding turret (21) for wrapping articles in a cardboard first blank (13), and a second folding turret (22) for wrapping articles in a second blank (20) of paper or film blank, wherein each of the folding turrets (21, 22), which are arranged adjacent to one another and rotate about respective axes in circular paths in a common upright plane, has four pockets (23, 24) open in the radial direction for receiving articles and blanks and wherein the articles are pushed into respective pockets (23, 24) located in a horizontal center plane of the first folding turret (21) or of the second folding turret (22), said apparatus further comprising:

a) means for always passing each article or pack group (11) through both folding turrets (21, 22), b) means for conveying, after being inserted into a pocket (23, 24), the article or pack group (11) along a semicircular path lying above the horizontal center plane;

c) means for pushing the packs (10) out of the second folding turret (22) in the horizontal plane and into an adjoining horizontal pack conveyor (58);

d) means for feeding the cardboard blanks (13) from a blank magazine (16) arranged below the folding turrets (21, 22) to a push-in station of the first folding turret (21) via a blank web (68); and for the purpose of applying glue to an outer folding tab or cover tab (114) of a blank (20), means for lifting the cover tab (114) from its folded position and for deforming it in such a way that an inner side, onto which glue is to be applied, faces outwards toward a gluing unit (112) arranged above a movement path of the packs (10).

14. The apparatus according to claim 13, characterized in that the folding tab or cover tab (114) is gripped by a transversely directed suction roller (115) that revolves about its own longitudinal axis, and on whose outer surface a subregion of the cover tab (114) is rolled up by virtue of rotational movement of the suction packs (10) in such a way that an edge region of the cover tab (114) is directed with its inner side facing up.

15. An apparatus for producing packs (10) by wrapping articles in alternatively one or more blanks for producing large packs (10), comprising pack groups (11), said apparatus comprising a first folding turret (21) for wrapping articles in a cardboard first blank (13), and a second folding turret (22) for wrapping articles in a second blank (20) of paper or film blank, wherein each of the folding turrets (21, 22), which are arranged adjacent to one another and rotate about respective axes in circular paths in a common upright plane, has four pockets (23, 24) open in the radial direction for receiving articles and blanks, and wherein the articles are pushed into respective pockets (23, 24) located in a horizontal center plane of the first folding turret (21) or of the second folding turret (22), said apparatus further comprising:

a) means for always passing each article or pack group (11) through both folding turrets (21, 22), b) means for conveying, after being inserted into a pocket (23, 24), the article or pack group (11) can be conveyed along a semicircular path lying above the horizontal center plane;

c) means for pushing the packs (10) out of the second folding turret (22) in the horizontal plane and into an adjoining horizontal pack conveyor (58);

d) means for feeding the cardboard blanks (13) from a blank magazine (16) arranged below the folding turrets (21, 22) to a push-in station of the first folding turret (21) via a blank web (68);

means for checking finished packs (10) in a region of pack scales (125) to determine whether their weight corresponds to a specified standard weight; and means for inserting packs determined to be faulty into a shaft (127) connected to the pack scales (125).

16. An apparatus for producing packs (10) by wrapping articles (11) in blanks comprising at least one folding turret (21) which has pockets (23, 24) outwardly open in the radial direction for receiving a blank (13) and an article, and means for pushing the blank (13) and the article into a respective pocket (23, 24) of the folding turret (21) located at a charging station (25), said apparatus further comprising:

a) means for inserting the blank (13) with the article into a pocket (23, 24) so that the blank (13) is wrapped around the article in the shape of a U, b) the article with the blank (13) folded in a U-shape being conveyed by the folding turret (21) out of the charging station (25), along a quarter-circle and into a top gluing station (35);

c) before or during a stepped conveying interval, means for folding radially outward folding tabs (31, 32), d) in a region of a gluing station (35) wherein the folding tabs (31, 32) become upright automatically, means for moving the folding tabs into an oblique position;

e) while the folding tabs (31, 32) are in the oblique position, means for applying glue to the outer side of the exposed inner tab (31) by an appropriately positioned glue nozzle (37); and f) means for again moving the folding tabs (31, 32) into a folded position by abutment to one another.

17. An apparatus for producing packs (10) by wrapping articles (11) in a blank (13), comprising at least one rotatable substantially circular folding turret (21) which has pockets (23, 24) outwardly open in the radial direction for receiving the blank (13) and an article, and means for pushing the blank (13) and article into a respective pocket (23, 24) of the folding turret (21) located at a charging station (25), said apparatus further comprising:

a) for the purpose of applying glue to an outer folding tab or cover tab (114) of a blank (20), means for lifting the folding tab or cover tab (114) from its folded position and for deforming it in such a way that an inner side of the tab, onto which glue is to be applied faces outwards;

b) arranged above the packs (10), a gluing unit (112) which applies glue to the outwardly-directed inner side of the folding tab or cover tab (114); and c) after glue has been applied to the inner side of the folding tab or cover tab (114), means for moving the tab (114) back to its folded position abutting an associated folding tab.

18. The apparatus according to claim 17, further comprising: a transversely directed suction roller (115) for gripping the folding tab or cover tab (114), said transversely directed suction roller (115) rotating about its own longitudinal axis and having on an outer surface thereof a subregion of the cover tab (114) that is rolled up, by the rotation of the suction roller (115) and by movement in a conveying direction of the packs (10), in such a way that an edge region of the cover tab (114) is directed with its inner side facing up for the application of glue.

* * * * *